US006478024B1

(12) United States Patent
White, Jr.

(10) Patent No.: US 6,478,024 B1
(45) Date of Patent: Nov. 12, 2002

(54) SNORKELING EQUIPMENT

(76) Inventor: Nathaniel White, Jr., 3518 Patterson Ave. #2, Richmond, VA (US) 23221

( * ) Notice: Subject to any disclaimer, the term of this patent is extended or adjusted under 35 U.S.C. 154(b) by 0 days.

(21) Appl. No.: 09/474,333

(22) Filed: Dec. 29, 1999

Related U.S. Application Data

(63) Continuation-in-part of application No. 08/893,663, filed on Jul. 11, 1997, now abandoned.

(51) Int. Cl.[7] ..... B63C 17/02

(52) U.S. Cl. ..... 128/201.11; 128/200.29; 128/201.22; 128/201.27

(58) Field of Search ..... 128/200.29, 201.11, 128/201.22–201.28, 204.26, 200.25, 207.11

(56) References Cited

U.S. PATENT DOCUMENTS

| | | | | | |
|---|---|---|---|---|---|
| 46,902 | A | * | 3/1865 | Hawkins | 128/201.11 |
| 156,599 | A | * | 11/1874 | Schmitz | 128/201.11 |
| 329,391 | A | * | 10/1885 | Huntley | 128/201.11 |
| 908,690 | A | * | 1/1909 | Neubert | 128/201.11 |
| 1,369,669 | A | * | 2/1921 | Kamenos | 128/201.11 |
| 2,839,053 | A | * | 6/1958 | Lorenz | 128/201.11 |
| 3,265,066 | A | * | 8/1966 | Katehis | 128/201.11 |
| 3,345,984 | A | * | 10/1967 | Katehis | 128/201.11 |
| 3,370,586 | A | | 2/1968 | Aragona et al. | |
| 3,951,142 | A | * | 4/1976 | Martin | 128/201.11 |
| 4,061,140 | A | * | 12/1977 | Saito | 128/201.11 |
| 4,245,632 | A | * | 1/1981 | Houston | 128/205.13 |
| 4,269,182 | A | * | 5/1981 | Le | 128/201.11 |
| 4,304,229 | A | | 12/1981 | Curtin | |
| 4,495,663 | A | | 1/1985 | Shieh | |
| 4,583,536 | A | * | 4/1986 | Jan | 128/201.11 |
| 4,662,819 | A | * | 5/1987 | Lakowske et al. | 415/129 |
| 4,674,493 | A | * | 6/1987 | Mitchell | 128/202.14 |
| 4,832,013 | A | * | 5/1989 | Hartdorn | 128/202.14 |
| 4,860,739 | A | * | 8/1989 | Vandepol | 128/201.11 |
| 4,896,664 | A | * | 1/1990 | Harayama | 128/200.25 |
| 4,938,211 | A | | 7/1990 | Takahashi et al. | |
| 5,020,191 | A | * | 6/1991 | Uke | 24/3 |
| 5,052,384 | A | * | 10/1991 | Kaneko | 128/205.14 |
| 5,092,327 | A | * | 3/1992 | Tragatschnig | 128/205.13 |
| 5,193,530 | A | * | 3/1993 | Gamow et al. | 128/201.27 |
| 5,297,545 | A | * | 3/1994 | Infante | 128/204.18 |
| 5,327,849 | A | * | 7/1994 | Miller | 114/315 |
| 5,351,681 | A | * | 10/1994 | Hudson | 128/201.11 |
| 5,471,976 | A | | 12/1995 | Smith | |
| 5,535,734 | A | | 7/1996 | Lu et al. | |
| 5,542,416 | A | * | 8/1996 | Chalvignac | 128/204.23 |
| 5,606,967 | A | * | 3/1997 | Wang | 128/201.11 |
| 5,622,165 | A | * | 4/1997 | Huang | 128/201.11 |
| 5,697,362 | A | * | 12/1997 | Albrecht | 128/201.11 |
| 5,720,279 | A | * | 2/1998 | Furuichi et al. | 128/204.26 |
| 5,893,362 | A | * | 4/1999 | Evans | 128/201.11 |
| 5,947,116 | A | * | 9/1999 | Gamow et al. | 128/201.11 |

FOREIGN PATENT DOCUMENTS

| | | |
|---|---|---|
| JP | 2-169393 | 6/1990 |

* cited by examiner

*Primary Examiner*—Aaron J. Lewis
*Assistant Examiner*—Joseph F. Weiss, Jr.
(74) *Attorney, Agent, or Firm*—Hunton & Williams

(57) ABSTRACT

Embodiments of improved snorkeling equipment are disclosed, each enabling a swimmer to submerge his or her head and body a few feet beneath the water surface, to swim freely beneath the water surface without concern for the position of the air tube, and to draw in and expend out air with ease.

21 Claims, 3 Drawing Sheets

SNORKELING EQUIPMENT

This is a continuation-in-part application of Ser. No. 08/893,663, filed on Jul. 11, 1997, now abandoned.

BACKGROUND OF THE INVENTION

1. Field of Invention

This invention relates to the field of snorkeling equipment. More specifically, this invention relates to snorkeling equipment that has been modified for use by a person who is unable to scuba dive because of certain physical limitations, but who nonetheless desires the recreational experience of swimming completely submerged in the water, as is the case in scuba diving.

2. Description of Prior Art

Certain people are physically unable to scuba dive because their ears cannot take the pressure of the greater depths, or because they have difficulty breathing the compressed gases used in breathing tanks. Moreover, scuba diving presents other obstacles to enjoyment. For example, scuba diving equipment can be expensive to own or rent, and the safe operation of such equipment requires training.

The recreational experience of completely submerged swimming, however, could be had if there were snorkeling equipment that permitted submerged swimming at depths of five feet or less, a range of depth where water pressure would be physically tolerable and air could be comfortably drawn into the lungs in lieu of compressed gases. The improved snorkeling equipment of this invention satisfies this recreational need.

Snorkeling equipment that is commonly available for recreational use generally consists of the following components: (1) a face mask with an adjustable rubber strap, (2) a rigid, J-shaped air tube, the short, curved end of which is fitted with a rubber mouthpiece, and (3) a rubber tether that secures the air tube to the rubber strap of the face mask so that the air tube freely depends therefrom when not in use. Although styles and materials may vary, snorkeling equipment must have these components, the basic features of which are constrained by the equipment's function as breathing apparatus designed to enable the swimmer's face to be completely submerged during swimming. To facilitate swimming, rubber or plastic swim fins may be provided as part of basic snorkeling equipment.

Because of the snorkeling equipment's basic functional design, the swimmer must swim along the water surface so that the long, straight end of the air tube clears the water surface and allows the swimmer to draw air into his or her mouth. Only the swimmer's face and the ventral side of his or her body remain submerged. Although the air tube could be lengthened to allow the swimmer's head and body to be completely submerged, this modification is not practical because the air tube when in use must remain more or less perpendicular with the water surface, and consequently, the range of movement of the swimmer's head and body would be severely limited by the allowable angle of the air tube relative to the water surface.

The improved snorkeling equipment of this invention has the following objectives: (1) to enable the swimmer to submerge his or her head and body a few feet beneath the water surface, (2) to enable the swimmer to swim freely beneath the water surface without concern for the position of the air tube, (3) to enable the swimmer to draw in and expend out air with ease, and (4) to provide the swimmer with snorkeling equipment of relatively simple construction and inexpensive parts for recreational use. These and other objectives will be apparent from the description below of the invention's preferred embodiments.

Others have made modifications to snorkeling equipment that are similar to some of the components of this invention in an effort to achieve the foregoing objectives. None of the prior art, however, describes, teaches, or suggests the novel combination taught by this invention. Nor does any of the prior art satisfactorily address all of the foregoing objectives.

U.S. Pat. No. 5,622,165 to Huang describes a snorkel diving device with a special floating disc that keeps the air tube above water level. Similarly, U.S. Pat. No. 5,351,681 to Hudson describes another design for a floating disc. Other designs that incorporate some sort of floating structure for maintaining the air tube above water are seen in U.S. Pat. No. 3,370,586 to Aragona, et al., and in Japanese Application No. 2-169393 to Tanaka.

Each of the foregoing designs lacks a lightweight, compact device that can provide a continuous flow of air to the swimmer so that the swimmer does not have to rely only on his or her diaphragm muscles to draw air from the atmosphere through the air pipe and down several feet of hose. It would be desirable for the swimmer to be able to draw in air with ease, notwithstanding the fact that he or she is completely submerged in water and has to draw air through a long hose connected to the air tube. When underwater, a swimmer's diaphragm must work against the pressure of water. Moreover, the length and diameter of the hose can present difficulties for breathing. The longer or narrower the hose is, the more work the diaphragm has to perform to draw in a sufficient volume of air.

Others have attempted to provide a suitable means for providing a continuous flow of air to the swimmer so that the swimmer does not have to rely only on his or her diaphragm muscles to draw air from the atmosphere through the air pipe and down several feet of hose. None of these solutions are satisfactory, however.

U.S. Pat. No. 5,535,734 to Lu, et al. discloses an optional fan blade assembly. (See FIG. 6 and Col. 4, lines 26–36.) This fan blade assembly is wind-driven. Looking at the drawing figure depicting the assembly, it is difficult to see that this assembly would provide a significant flow of air to the swimmer. For one thing, the small fan blade assembly, being disposed inside the narrow breathing tube, would not have a sufficient volume of air to propel. Moreover, the large fan blade assembly protruding through the top of the breathing apparatus is entirely dependent on wind action, which is unpredictable. Indeed, the more wind there is to drive the large fan blade assembly, the rougher the water will be, and the less stable and more prone to capsizing the floating structure will be.

Lu et al. teaches away from the use of gasoline-powered air pumps and other mechanically driven devices because of the known risks of mechanical failure from use of the device in water and contamination of breathing air from engine exhaust. (See Col. 1, lines 38–52.) These disadvantages are inherent in the invention of U.S. Pat. No. 4,832,013 to Hartdorn, which discloses the use of a gasoline-powered air compressor. As seen in the disclosure, this design must be able to eliminate excess engine heat, noxious exhaust gases, and water accumulation. (See Col. 2, lines 27–59.) As a result, the design is overly complicated and cumbersome.

U.S. Pat. No. 5,471,976 to Smith discloses a battery operated air pump. Smith employs the air pump, however, in conjunction with a "contractible tube concept" which accumulates an air supply between breath. (See Col. 2, lines 20–28.) As indicated in the disclosure, without the contractible tube concept, Smith's portable electric air pump and battery system could not deliver the necessary flow of air. Smith also employs a low pressure regulator to regulate the flow rate and pressure for safe breathing. (See Col. 2, lines 38–40.) Like Hartdorn, Smith improves upon the conventional air pump used in the diving art. An air pump, whether gasoline-powered or battery-powered, however, does not meet the objectives of this invention.

BRIEF SUMMARY OF THE INVENTION

The improved snorkeling equipment of this invention has a rigid air tube that is fitted to a float so that the air tube is kept afloat in a stable position more or less perpendicular to the water surface. Inside the floating structure is a centrifugal fan which draws the air in from the air tube and forces it to the swimmer's mouthpiece via several feet of flexible tubing. A purge valve system consisting of (1) a purge valve intake fitted between the flexible tubing and the mouthpiece, through which fresh air passes to the lungs and (2) a reservoir purge valve outlet fitted on the mouthpiece, through which stale air passes from the lungs directly into the water instead of flowing back up the air tube, ensures an unidirectional flow of air from the air tube to the mouthpiece.

BRIEF DESCRIPTION OF THE SEVERAL VIEWS OF THE DRAWING

This invention is further described with the following drawings, in which.

DETAILED DESCRIPTION OF THE INVENTION

Figure 1:
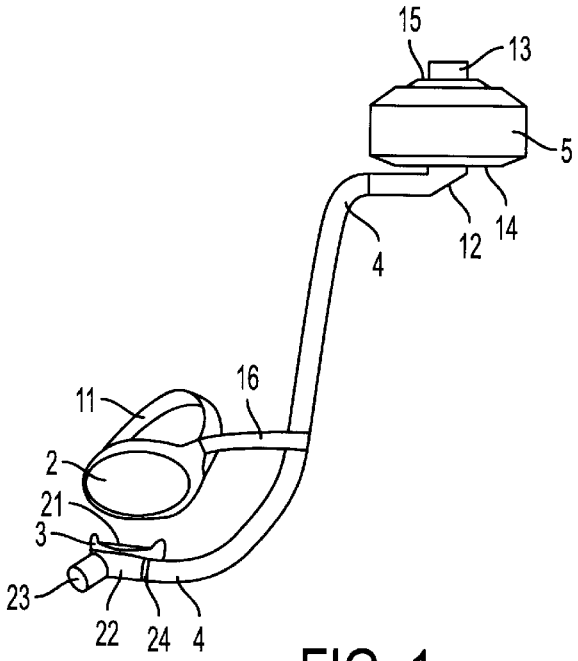
FIG. 1 is a perspective view of the modified snorkeling equipment constructed in accordance with the teachings of the present invention.

A preferred embodiment of this invention is shown in FIG. 1. It has a mouthpiece 3 to which a segment of flexible tubing 4 is attached and sealed at one end; a float 5 which has a connecting joint 12 to which the segment of flexible tubing 4 is attached and sealed at its other end, a rigid air tube 13, and a switch 14 for turning the fan inside the float on and off. The float 5 may be of virtually any shape, but preferably has a bow 15 to facilitate its travel on water along the direction of the arrow. The mouthpiece 3 has a rubber bitepiece 21, a trunk 22, a reservoir purge valve outlet 23, and a purge valve intake 24. The invention optionally has a face mask 2 with an adjustable strap 11, and a rubber or woven fabric tether 16 that is fitted around the segment of flexible tubing 4 and the adjustable strap 11 of the face mask 2.

Figure 2:
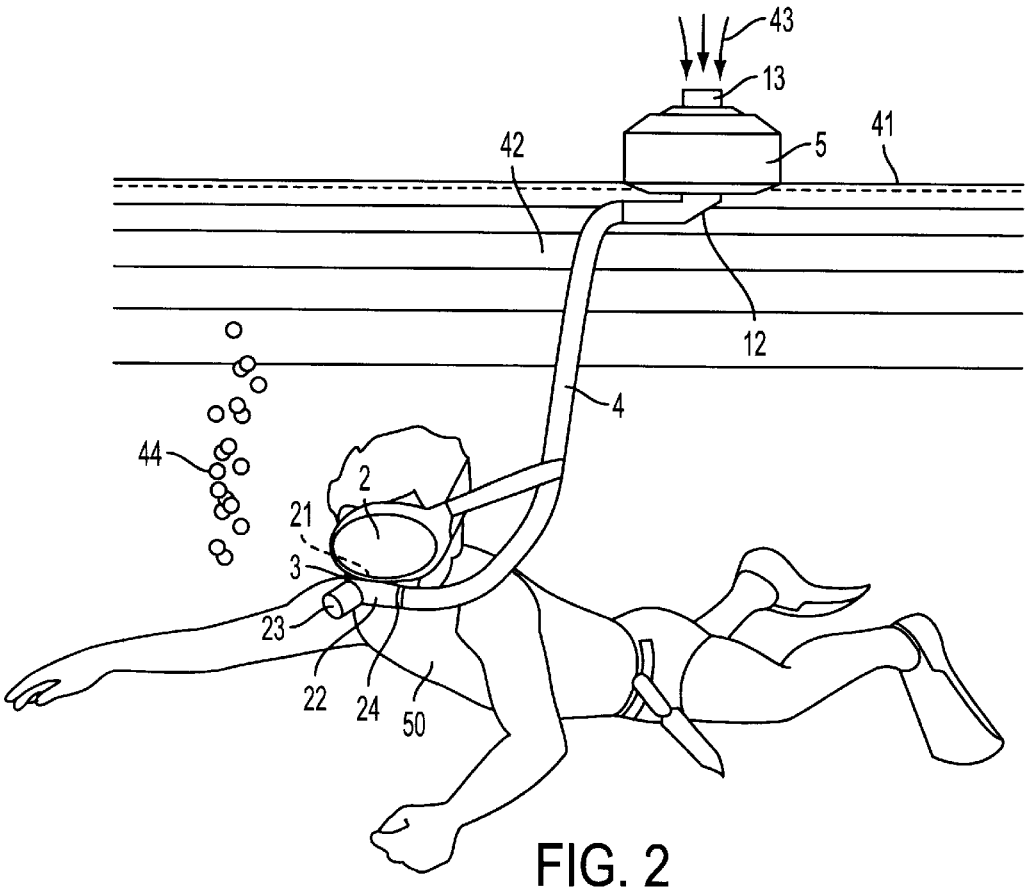
FIG. 2 is an environmental view of the modified snorkeling equipment that shows its use.

This invention is shown in use in FIG. 2. The float 5 bobs along at water surface 41 and keeps the air tube 13 in a stable position, more or less perpendicular to the water surface 41. The flexible tubing 4 freely depends in the water 42 from the float 5 at the connecting joint 12. Fresh air 43 is drawn into the air tube 13, through the flexible tubing 4, through the purge valve intake 24, into the trunk 22 of the mouthpiece 3 and then into the lungs of the swimmer 50 via the bitepiece 21. Stale air (shown as bubbles) 44 breathed out of the lungs of the swimmer 50 passes directly into the water 42 through the reservoir purge valve outlet 23.

Figure 3:
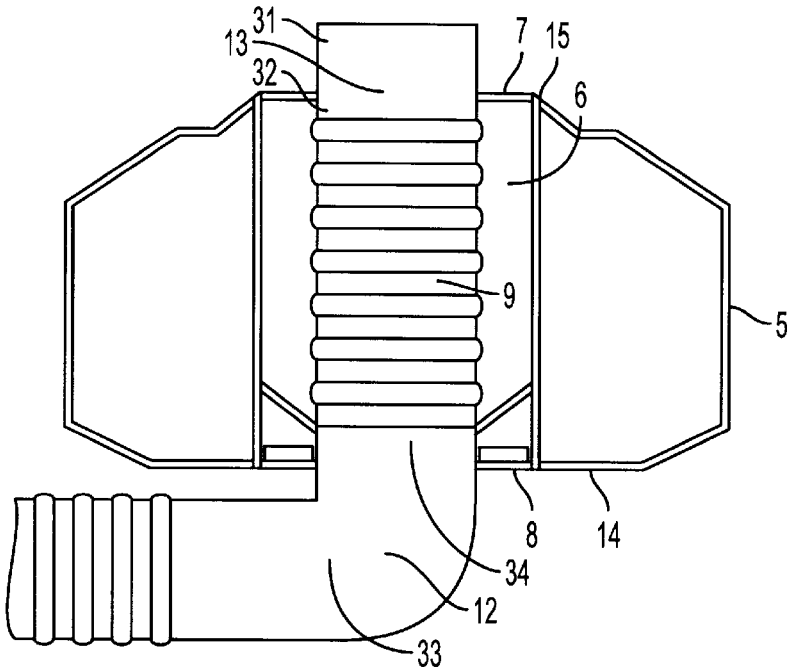
FIG. 3 is a cross-sectional view of the float from one side, revealing the placement of the centrifugal fan and the power supply.

The arrangement of the components inside the float 5 is revealed in the cross-sectional view of FIG. 3. There is scroll shaped housing 6 that houses a centrifugal fan 7. The centrifugal fan preferably has backward-curved blades 8. Air is drawn through the air tube 13 and into the scroll shaped housing 6 where it moves in a clockwise direction (shown by the arrows) out of the housing outlet 9. The fan 7 and its housing 6 are enclosed within one compartment 31 of the float 5. A connecting joint 32 perforating one of the walls of compartment 31 connects the housing outlet portion 9 to one end of a segment of flexible tubing 33. This segment 33 is inside another compartment 34. Another connecting joint 35 perforating one of the walls of compartment 34 joins the other end of the segment 33 to one end of another segment of flexible tubing 36. This segment 36 is inside another compartment 37. The other end of this segment of flexible tubing 36 is connected to connecting joint 12, which in turn connects to the tubing 4. The purpose of having multiple compartments inside the float 5 is to segregate the air supply from the fan motor (situated behind the fan 7 and therefore not seen in this FIG.) and the power supply 38. The power supply 38, preferably a lantern battery having a voltage compatible with the fan motor, is in a separate compartment 39. A 6-volt lantern battery will power the fan for about two hours. All of the compartments are watertight.

"In an embodiment of the present invention, for example, the float 5 may comprise a toroidal mass of buoyant material having a space around the axis of the toroidal mass. The components described above are placed in this space. The space has a side, a top and a base, wherein the side of such space is enclosed by the toroidal mass. The top of the space is enclosed and sealed by a first circular cap and base of the space is enclosed and sealed by a second circular cap."

Figure 4:
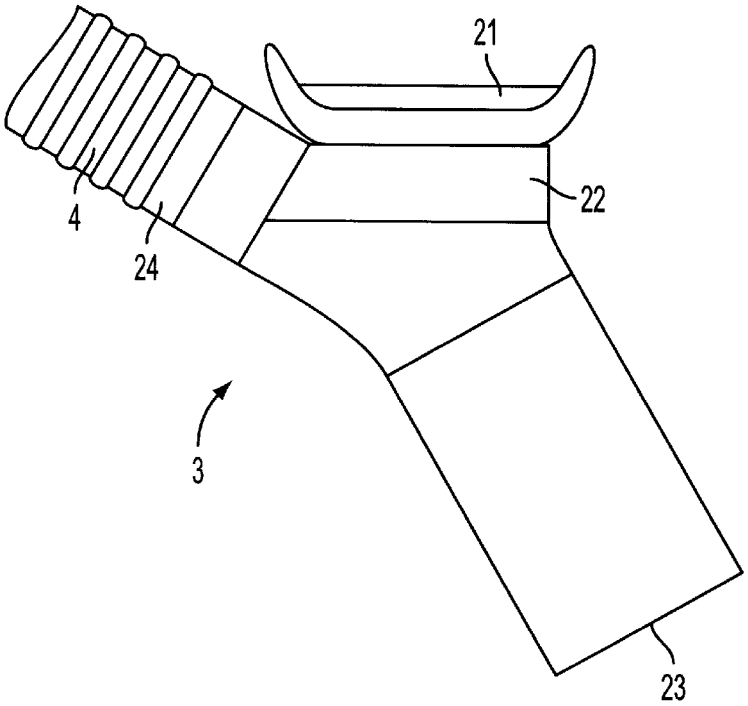
FIG. 4 is a close-up, partial cross-sectional view of the mouthpiece and a partial segment of the flexible tubing, revealing the purge valve system consisting of the purge valve intake and the reservoir purge valve outlet.

The construction of the mouthpiece 3 is revealed in FIG. 4. The mouthpiece 3 is Y-shaped, with a hollow trunk 22 that branches into a rubber bitepiece 21, a purge valve intake 24 and a reservoir purge valve outlet 23. The flexible tubing 4 is attached and sealed to the purge valve intake 24.

Figure 5:
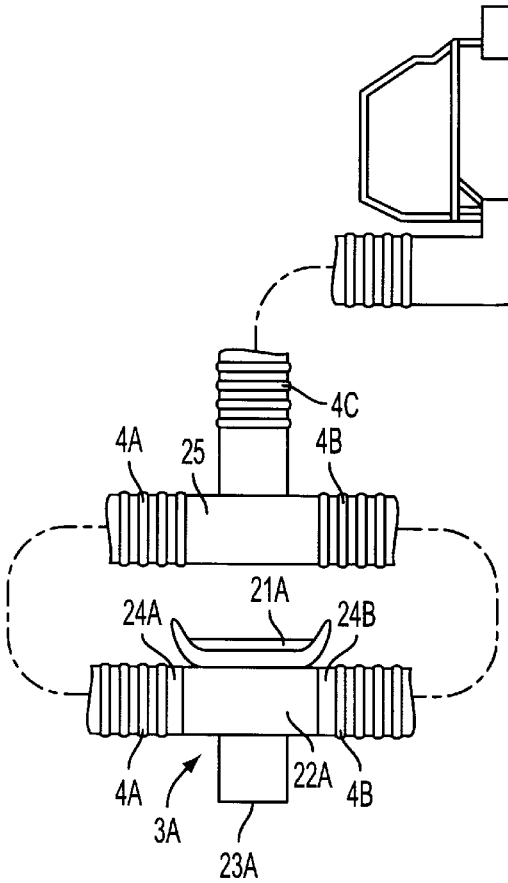
FIG. 5 is a view of another preferred embodiment of this invention, with the mouthpiece modified to permit two segments of flexible tubing to feed into it.
Figure 6:
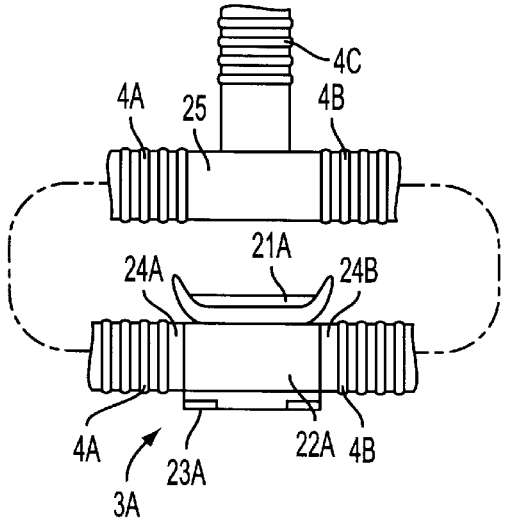
FIG. 6 is a view of still another preferred embodiment of this invention, with the mouthpiece modified to permit two segments of flexible tubing to feed into it, but with the purge valve intakes fitted at different positions.

FIGS. 5 and 6 illustrate two additional embodiments of this invention. In FIG. 5, the mouthpiece 3A is cruciate in shape, such that the hollow trunk 22A branches into a rubber bitepiece 21A, a reservoir purge valve outlet 23A directly opposite the bitepiece 21A, and two purge valve intakes 24A and 24B. Attached and sealed to the purge valve intakes 24A and 24B are two segments of flexible tubing 4A and 4B which are joined together at their other ends and to another segment of flexible tubing 4C by a rigid T-joint 25. The flexible tubing 4C is attached at its other end to the float 5 in the manner shown in FIG. 3.

In FIG. 6, the mouthpiece 3A again is cruciate in shape. In this embodiment, however, the hollow trunk 22A branches into the bitepiece 21A, a reservoir purge valve outlet 23B of a different design from that of 23A, and the two segments of flexible tubing 4A and 4B. The two purge valve intakes 24A and 24B are fitted to the segments of flexible tubing 4A and 4B at their opposite ends, and to thee rigid T-joint 25. The flexible tubing 4C is again attached to the rigid T-joint 25 as shown in FIG. 5.

Figure 7:
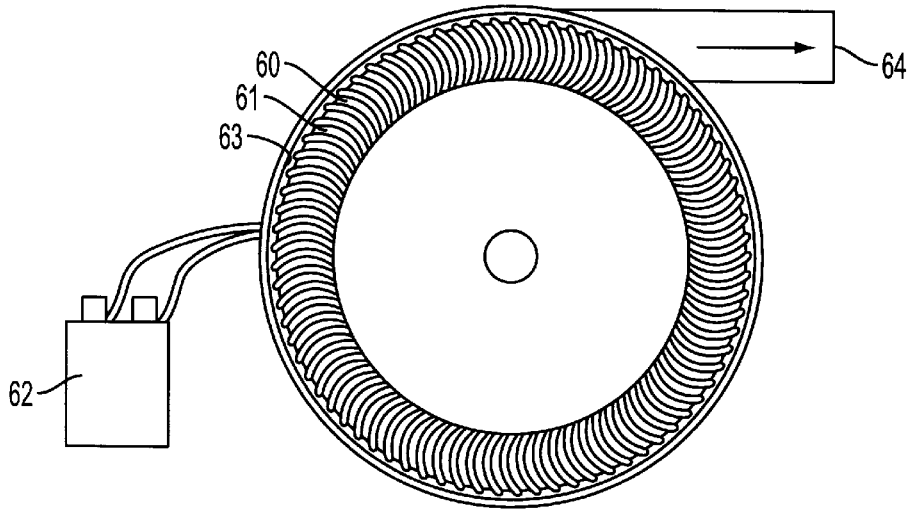
FIG. 7 is a close-up, partial cross-sectional view of the float from the top plan, revealing the placement of the centrifugal fan relative to the motor.

In FIG. 7, the centrifugal fan 7 in its scroll shaped housing 6 is shown along with the fan motor 60. A drive shaft 61 connects the fan 7 to the motor 60. The shaft 61 perforates a wall that separates the compartment 31 in which the fan 7 and the fan housing 6 are enclosed from the compartment 62 in which the motor 60 is enclosed. The motor 60 is preferably a 6-volt, 3-amp motor.

The drive shaft 61 perforates the wall separating the fan from the motor, but it has a watertight fitting 63 with a cotton greased plate or cap to prevent water from seeping into the motor compartment 62. In this manner, the motor stays dry. Note that the scroll shaped housing 6 has an inlet portion 10 that is joined to the air tube 13. Arrows in this FIG. again show the direction of travel of the air.

As seen in FIG. 3, the battery 38 is also housed in a separate compartment 39. In the event that water does seep into the battery compartment, any leakage from the battery is contained and kept away from the air supply.

The supply of a motorized fan or some other means of forcibly drawing air through the air tube will enable this invention to be used optimally for swimming at depths of 3 to 5 feet. This invention is not designed for use at depths beyond 5 feet, as professional divers and snorkelers recommend that one have special training before swimming at depths beyond 5 feet.

The selection of a centrifugal fan is critical to the performance of this invention. A centrifugal fan operating within a scroll shaped housing permits the efficient distribution of air which is drawn through the inlet and forced out in one direction through the outlet. The backward-curved blades, which generate less static pressure than forward-curved blades at the same speed of rotation, are preferable because they operate at high efficiency and have non-overloading power characteristics. These performance characteristics inherent in backward-curved blades enable the fan to operate efficiently without the risk of overloading a small 6-volt, 3-amp motor.

Absent a complete immersion of the fan in water, motor overload and failure is unlikely. Any water that splashes into the scroll shaped housing from the inlet will be expelled with the air through the outlet as a result of the fan action. The passage of some amount of water through the flexible tubing to the swimmer does not present a problem because the swimmer can easily expel that water through the reservoir purge valve outlet.

The selection of low voltage, low amperage motor is preferred. A small motor allows the fan to be powered by a cheap, lightweight lantern battery. It also ensures that the entire assembly remains compact and portable.

While preferred embodiments of the invention have been shown and described, it will be apparent to those skilled in this art that various modifications may be made in these embodiments without departing from the spirit of the present invention. For that reason, the scope of the invention is set forth in the following claims.

I claim:

1. A snorkeling equipment comprising:

an air tube;

a float means enabling the air tube to float in a stable position in water;

a connecting joint located on the float means;

a centrifugal fan located within the float means, the centrifugal fan driven by a battery-powered motor for forcibly drawing air through the air tube;

a mouthpiece having a plurality of openings and having a means for directing a flow of air for inhalation through at least one opening and a flow of exhaled air through at least one other opening, with the mouthpiece and the device for directing air flow further comprising:

a) a hollow trunk having a first branch, a second branch, a third branch and a fourth branch;

b) a bitepiece which is attached and sealed to the first branch of the trunk;

c) a reservoir purge valve outlet which is attached and sealed to the second branch of the trunk; and d) a first purge valve intake attached and sealed to the third branch of the trunk and a second purge valve intake attached and sealed to the fourth branch of the trunk; and a flexible tubing having a first end which is connected to the mouthpiece and having a second end which is connected to the connecting joint on the float means such that fresh air can be drawn through the air tube down to the mouthpiece.

2. The snorkeling equipment of claim 1, including a face mask with an adjustable strap, and a tether having one end of the tether fitted around the adjustable strap and having another end of the tether fitted around the flexible tubing.

3. The snorkeling equipment of claim 2, wherein the tether is made of rubber or woven fabric.

4. The snorkeling equipment of claim 1, wherein the float means comprises a toroidal mass of buoyant material having a space around a central vertical axis of the toroidal mass, with a side, a top and a base when the snorkeling equipment is in operation, wherein the side of said space is enclosed by the toroidal mass, and wherein the top of said space is enclosed and sealed by a first circular cap and base of said space is enclosed and sealed by a second circular cap; and the air tube perforating the first circular cap at the top of the space and being attached and sealed thereto, the connecting joint perforating the second circular cap at the base of the space and being attached and sealed thereto.

5. The snorkeling equipment of claim 1, where the mouthpiece and the device for directing air flow further comprises:

a T-joint having a first opening and a second opening opposite to each other, and a third opening;

first and second segments of flexible tubing each having a first end and a second end;

where said first end of said first segment of flexible tubing is attached to said first opening of T-joint and said second end of said first segment of flexible tubing is attached to said first purge valve intake, and where said first end of said second segment of flexible tubing is attached to said second opening of T-joint and said second end of said second segment of flexible tubing is attached to said second purge valve intake; and a third segment of flexible tubing having a first end and a second end where said first end is connected to the third opening of the T-joint and said second end is connected to the connecting joint on the float means.

6. The snorkeling equipment of claim 1, wherein the float means further comprises a segment of flexible tubing operatively connecting the air tube to the connecting joint located on the float means and being attached and sealed to both the air tube and the connecting joint.

7. The snorkeling equipment of claim 1, wherein the motor is a 6-volt, 3-amp motor and the battery is a 6-volt lantern battery.

8. The snorkeling equipment of claim 1, wherein the mouthpiece and the means for directing air flow comprise a hollow trunk having four branches, a rubber bitepiece which is attached and sealed to one branch of the trunk, a reservoir purge valve outlet which is attached and sealed to another branch of the trunk, and two purge valve intakes which are attached and sealed to the remaining branches of the trunk, and the snorkeling equipment further comprising two segments or flexible tubing which are attached and sealed at one end of each to the two purge valve intakes, and connected at the other end of each to opposing openings of a T-joint, and a third segment of flexible tubing which is connected at one end to the third opening of the T-joint and at the other end to the elbow joint.

9. The snorkeling equipment of claim 1, wherein the centrifugal fan has backward curved blades.

10. The snorkeling equipment of claim 1, wherein the float means comprises a scroll shaped housing for the centrifugal fan.

11. The snorkeling equipment of claim 1, wherein the float means have multiple compartments.

12. The snorkeling equipment of claim 1, wherein the float means has a bow to facilitate the float means' travel on the water.

13. The snorkeling equipment of claim 1, wherein the float means has a switch located on it to turn the centrifugal fan inside the float on or off.

14. The snorkeling equipment of claim 3, wherein the bitepiece is made of rubber.

15. The snorkeling equipment of claim 1, where the mouthpiece and the device for directing air flow further comprises:

a T-joint having a first opening and a second opening opposite to each other, and a third opening;

first and second segments of flexible tubing each having a first end and a second end;

where said first end of said first segment of flexible tubing is attached to said first opening of T-joint and said second end of said first segment of flexible tubing is attached to said first purge valve intake, and where said first end of said second segment of flexible tubing is attached to said second opening of T-joint and said second end of said second segment of flexible tubing is attached to said second purge valve intake; and a third segment of flexible tubing having a first end and a second end where said first end is connected to the third opening of the T-joint and said second end is connected to the connecting joint on the float means.

16. The snorkeling equipment of claim 1, wherein the battery powered motor and the centrifugal fan are located in different compartments of the float means separated by a wall.

17. The snorkeling equipment of claim 15, wherein the battery powered motor is connected to the centrifugal fan by a drive shaft perforating the separating wall.

18. The snorkeling equipment of claim 16, wherein the drive shaft is fitted through the perforation with a watertight fitting to prevent water from sipping into the motor compartment.

19. The snorkeling equipment of claim 17, wherein the watertight fitting is made of a cotton greased plate.

20. A snorkeling equipment comprising:

an air tube;

a float means enabling the air tube to float in a stable position in water;

a connecting joint located on the float means;

a centrifugal fan located within the float means, which is driven by a battery-powered motor for forcibly drawing air through the air tube;

a mouthpiece having a plurality of openings and having a device for directing a flow of air for inhalation through at least one opening and a flow of exhaled air through at least one other opening; with the mouthpiece and the device for directing air flow further comprising:

a hollow trunk having a first branch, a second branch, a third branch and a fourth branch;

a bitepiece which is attached and sealed to said first branch of the trunk;

a reservoir purge valve outlet which is attached and sealed to said second branch of the trunk;

a first purge valve intake attached and sealed to said third branch of the trunk, and a second purge valve intake attached and sealed to said fourth branch of the trunk;

a T-joint having a first. opening and a second opening opposite to each other, and a third opening;

first and second segments of flexible tubing each having a first end and a second end;

where said first end of said first segment of flexible tubing is attached to said first opening of T-joint and said second end of said first segment of flexible tubing is attached to said first purge valve intake, and where said first end of said second segment of flexible tubing is attached to said second opening of T-joint and said second end of said second segment of flexible tubing is attached to said second purge valve intake; and a third segment of flexible tubing having a first end and a second end where said first end is connected to the third opening of the T-joint and said second end is connected to the connecting joint on the float means.

21. A snorkeling equipment comprising:

an air tube;

a float means enabling the air tube to float in a stable position in water;

a connecting joint located on the float means;

a centrifugal fan located within the float means, which is driven by a battery-powered motor for forcibly drawing air through the air tube;

a mouthpiece having a plurality of openings and having a device for directing a flow of air for inhalation through at least one opening and a flow of exhaled air through at least one other opening; with the mouthpiece and the device for directing air flow further comprising:

a hollow trunk having a first branch, a second branch, a third branch and a fourth branch;

a bitepiece which is attached and sealed to said first branch of the trunk;

a reservoir purge valve outlet which is attached and sealed to said second branch of the trunk;

a T-joint having a first opening and a second opening opposite to each other, and a third opening;

first and second segments of flexible tubing each having a first end and a second end;

where said first end of said first segment of flexible tubing is attached to said first opening of T-joint and said second end of said first segment of flexible tubing is attached to said first purge valve intake, and where said first end of said second segment of flexible tubing is attached to said second opening of T-joint and said second end of said second segment of flexible tubing is attached to said second purge valve intake; and a third segment of flexible tubing having a first end and a second end where said first end is connected to the third opening of the T-joint and said second end is connected to the connecting joint on the float means.

* * * * *